United States Patent [19]

Palmer

[11] 4,426,076

[45] Jan. 17, 1984

[54] TUMBLING BOARD AND SPRING ASSEMBLY

[76] Inventor: Leonard Palmer, 1168 Westwood Trail, Addison, Ill. 60101

[21] Appl. No.: 218,779

[22] Filed: Dec. 22, 1980

Related U.S. Application Data

[63] Continuation-in-part of Ser. No. 164,587, Jun. 30, 1980, Pat. No. 4,360,197.

[51] Int. Cl.[3] ..... A63B 5/00; E02F 15/22

[52] U.S. Cl. ..... 272/109; 52/593; 108/136

[58] Field of Search ..... 272/3, 56.5 SS, 93, 272/109, 65, 66, 70; 108/153, 901, 902; 267/60; 5/420, 475; 46/30; 52/593, 595, 589, 594; 404/18, 35, 41

[56] References Cited

U.S. PATENT DOCUMENTS

| | | | |
|---|---|---|---|
| 1,778,927 | 10/1930 | Wright | 404/41 |
| 1,978,075 | 10/1934 | Butterworth | 52/589 X |
| 3,169,757 | 2/1965 | Roder et al. | 267/60 |
| 3,406,617 | 10/1968 | Randazzo | 272/56.5 SS |
| 3,650,224 | 3/1972 | Petix et al. | 108/901 X |
| 3,694,983 | 10/1972 | Couquet | 275/56.5 SS X |
| 4,054,987 | 10/1977 | Forlenza | 272/3 X |
| 4,274,626 | 6/1981 | Grosser et al. | 272/109 |

FOREIGN PATENT DOCUMENTS

| | | | |
|---|---|---|---|
| 2149783 | 4/1972 | Fed. Rep. of Germany | 272/3 |
| 2373306 | 8/1978 | France | 272/109 |
| 513310 | 11/1971 | Switzerland | 272/3 |

*Primary Examiner*—Richard J. Johnson
*Attorney, Agent, or Firm*—Wood, Dalton, Phillips, Mason & Rowe

[57] ABSTRACT

A tumbling board construction including a sheet of material of sufficient strength to support a mat or the like, preferably molded of plastic. The sheet has a generally rectangular periphery, an upper face and a lower face, and a plurality of stationary male and female interlocking devices are disposed about the periphery in alternating fashion and below the upper face. The interlocking devices are generally upwardly and downwardly directed. Identical sheets, through proper orientation, may be interlocked together to form a support for a tumbling mat.

5 Claims, 10 Drawing Figures

TUMBLING BOARD AND SPRING ASSEMBLY

CROSS REFERENCE

This application is a continuation-in-part of my copending application Ser. No. 164,587, filed June 30, 1980 now patent 4,360,197 and entitled "Spring Assembly for a Tumbling Board."

BACKGROUND OF THE INVENTION

This invention relates to tumbling boards, and more particularly, to tumbling boards with spring assemblies and which are interconnected to provide a support surface for a tumbling mat or the like.

In the gymnastic sport of tumbling, athletes perform various maneuvers on mats or the like, many of which require the athlete to spring high into the air with the maneuver being performed in mid air. This, of course, amongst other things, requires that the athlete have considerable "spring" in his or her legs. Frequently, in practice sessions and competitive meets, the spring in the athlete's legs is artificially enhanced through the use of tumbling boards which support the mat on which the athlete is performing. In the usual case, the tumbling board is formed of one or more large sheets which are interconnected if more than one is used. A plurality of spring assemblies are secured to the underside of each such board and support the board in a slightly elevated fashion, frequently on the order of 2 inches, above the underlying floor or the like. Consequently, the athlete performing on such a tumbling board, while moving downwardly under the influence of gravity, upon impacting against the mats supported by the tumbling board, will cause compression of the springs. After initial compression of the springs due to the inertia of the athlete, the springs tend to elevate the tumbling board and move the athlete upwardly thereby providing the aforementioned artificial assist to the spring in the athlete's legs.

Heretofore, the tumbling boards and spring assemblies have typically been in the form of plywood sheets mounting helical springs of perhaps two inches in length and one inch in diameter. The springs are secured at designated locations to the underside of the tumbling boards by washers placed between adjacent convolutions of the springs near one end thereof with the washers then receiving a threaded fastener or the like which impales the tumbling board. Thus, the washers sandwich one end of the associated spring against the board and in turn are held in place by a fastener. The various boards are provided, at their peripheries, with interlocking devices whereby a series of boards may be interlocked together to provide a sufficiently large surface for a large gymnastic mat or the like. In some cases, hinges are employed with removable hinge pins or pintles being employed to interlock the hinge leaves which are placed on adjacent boards. Other types of movable interlocking devices have also been employed.

In any event, as pointed out in my previously identified copending application, this type of construction has provided some difficulty in that the spring assemblies frequently become inadvertantly disassociated from the board, and the spring assembly disclosed in my application overcomes this difficulty. Still another difficulty is present in the prior art method of securing the boards together as well as taking them apart after a meet or practice session or the like because each interlocking device must be manually manipulated to release one board from another and where large mats are used, it is extremely time consuming to disassemble all of the tumbling boards required to support such a mat.

SUMMARY OF THE INVENTION

It is the principal object of the invention to provide a new and improved tumbling board. More specifically, it is an object of the invention to provide a tumbling board that may be easily connected to or disconnected from other, like tumbling boards.

An exemplary embodiment of the invention achieves the foregoing objects in a tumbling board construction including sheet of material of sufficient strength to support a mat or the like. The sheet has a generally rectangular periphery, an upper face and a lower face. A plurality of stationary, male and female interlocking devices are disposed about the periphery in alternating fashion and located below the upper face. The interlocking devices are generally upwardly and downwardly directed so as to insure continued operation of the interlocking devices notwithstanding localized vertically applied forces as a result of a tumbling performance being performed on a mat supported by the tumbling board.

In a preferred embodiment of the invention, two opposed sides of the sheet are about twice the length of the remaining sides and there are six of the interlocking devices, two on each of the opposed sides and one on each of the remaining sides.

In a highly preferred embodiment, the lower face of the tumbling board includes a plurality of downwardly directed, integral bosses for receiving spring assemblies, such as the spring assemblies of my copending application, thereon in a wedging fashion.

In a like vein, a highly preferred embodiment of the invention includes a plurality of apertures which extend through the sheet between the faces to lessen the mass of the sheet to thereby decrease the amount of material required to form the sheet as well as decrease the weight of the sheet to improve its portability.

Preferably, the male interlocking devices comprise upwardly directed, horizontally elongated flanges and the female interlocking devices comprise downwardly opening, horizontally elongated channels of a width sufficient to receive one of the flanges. The interlocking devices have a total peripheral extent substantially equal to the length of the periphery of the sheet and all have a substantially equal length along the periphery such that when two of the sheets are interlocked together, adjacent ends of adjacent male and female interlocking devices prevent relative lateral movement between the sheets in at least one direction.

The use of alternating male and female interlocking devices according to the preferred embodiment allows identical sheets forming the tumbling boards to be interlocked in a variety of configurations thereby allowing the manufacture of but a single type sheet by which the configurations necessary for tumbling can all be achieved.

Other objects and advantages will become apparent from the following specification taken in connection with the accompanying drawings.

DESCRIPTION OF THE PREFERRED EMBODIMENTS

Figure 1:
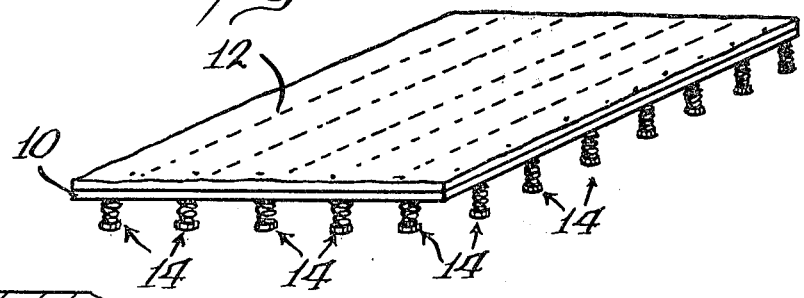
FIG. 1 is a perspective view of a tumbling board and mat with spring assemblies and made according to the invention.

Exemplary embodiments of tumbling boards and spring assemblies made according to the invention are illustrated in the drawings. As illustrated in FIG. 1, there is provided a tumbling board 10 which is sheetlike in nature and has a rectangular periphery. Superimposed on the tumbling board 10 is a gymnastic mat while a plurality of spring assemblies, generally designated 14, are secured to the underside of the tumbling board 10 on, for example, regularly spaced centers. The lower ends of the assemblies 14 support the tumbling board 10 in an elevated relation above a floor or the like and conventionally will provide about a two inch spacing.

Figure 2:
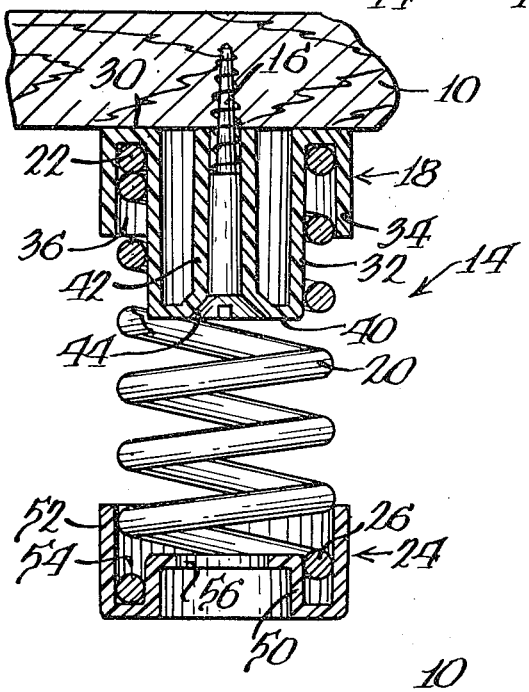
FIG. 2 is an enlarged, fragmentary sectional view of one form of spring assembly which may be employed with the tumbling board.

Turning now to FIG. 2, one form of a spring assembly made according to the invention is shown to be secured to the underside of the tumbling board 10 by a flathead screw 16. The spring assembly is made up of three basic components. The first is a cap, generally designated 18. The second is a helical spring 20 having an end 22 captured by the cap 18 as will be seen. The third component is a protective cover, generally designated 24, which receives the opposite ends 26 of the spring 20. In general, the cap 18 serves to mount the entire assembly to the tumbling board 10 while the protective cover 24 serves principally to protect the underlying surface on which the tumbling board may be disposed from marring or the like by the spring end 26.

The cap 18 includes a generally flat base 30 for abutment with the underside of the tumbling board 10. Generally, the base 30 will have a circular periphery.

Inwardly of the periphery of the base 30, there is a generally cylindrical projection 32 which extends away from the base 30 coaxially with the helical axis of the spring 20 and into the end 22 thereof.

Radially outwardly of the projection 32 and extending from the base 30, there is an annular lip 34 which, with the projection 32, defines an annular groove 36 for receipt of the spring end 22.

Preferably, the cap 18 is formed of a plastic material, that is one having inherent resilience. The material must also be deformable.

The groove 36 is constructed such that it progressively narrows from its open end as the base 30 is approached. It is further constructed such that the spring end 22 cannot fully enter the same without deforming the plastic so that the inherent resilience of the plastic will cause the cap to tightly grasp the spring end 22. This can be accomplished in a variety of ways but a preferred method is to make the cylindrical projection 32 slightly frusto conical as, for example, having the sides thereof extend at a 1° angle to the helical axis of the spring and by causing the inner surface of the lip 34 to be formed at an identical, but opposite 1° angle such that the bottom of the groove 34 is narrower than the diameter of the wire of which the spring 20 is formed. Preferably, also, the outer diameter of the projection 32 adjacent the bottom of the groove 34 is slightly greater than the inner diameter of the spring 20 while the inner diameter of the lip 34 at the bottom of the groove 36 is slightly less than the outer diameter of the spring 20.

The projection 32 includes a flat end 40 opposite from the base 30 which in turn merges into an axially extending tube 42 which terminates in the plane of the base 30. The tube 42 defines an elongate hole or aperture for receipt of the screw 16 and preferably, the projection end 40 is provided with a countersunk formation 44. Thus, the screw 16 may be introduced through the tube 42 and theaded into the tumbling board 10.

Preferably, the projection 32 has a greater axial length than the lip 34. This axial length serves to pilot the spring end 22 into the groove 36 during assembly.

The protective cover 24 includes a central projection 50 which is received in the spring end 26 and a radially outwardly spaced, annular lip 52. The lip 52 surrounds the outer diameter of the spring end 26 and with the projection 50 defines an annular groove 54. The cover 24 is likewise formed with plastic and preferably, the projection 50 and lip 52 are configured with respect to each other and with respect to the spring end at angles and relations like those described in connection with the cap 18 so as to firmly grasp the spring end 26. The cover 24 is completed by an enlarged central aperture 56 of sufficient size that when the components are assembled together as illustrated in FIG. 2, the flathead screw 16 may be introduced through the aperture 56 and a screwdriver inserted therethrough to thread the screw 16 into the tumbling board 10.

In the embodiment illustrated in FIG. 2 and described above, installation can be accomplished in a variety of ways. If desired, the spring 20 and cover 26 may be removed from the cap 18 and the latter secured in place by means of the screw. Then, the spring end 22 may be forced into the groove 36 to complete the assembly. Alternately, and as alluded to above, if desired, the entire spring assembly can be installed without prior disassembly by introducing the screws 16 through the aperture 56 in the cover 24.

The assembly just described is easy to install and because the plastic cap 18 and cover 24 firmly grasps respective ends of the spring 20, will not inadvertantly disassemble during use. However, on occasion, if the tumbling board 10 with the spring assemblies in place is picked up and moved as for storage purposes, there is the possibility that forces directed against the spring 20 may cause the spring end 22 to slip from the groove 36. This disassociation is easiy taken care of simply by placing the spring end 22 over the projection 30 and forcing the spring end 22 into the bottom of the groove 36. Where, however, disassembly of any sort is to be absolutely prevented, the embodiment of spring assembly illustrated in FIGS. 3 and 4 may be used.

Figure 3:
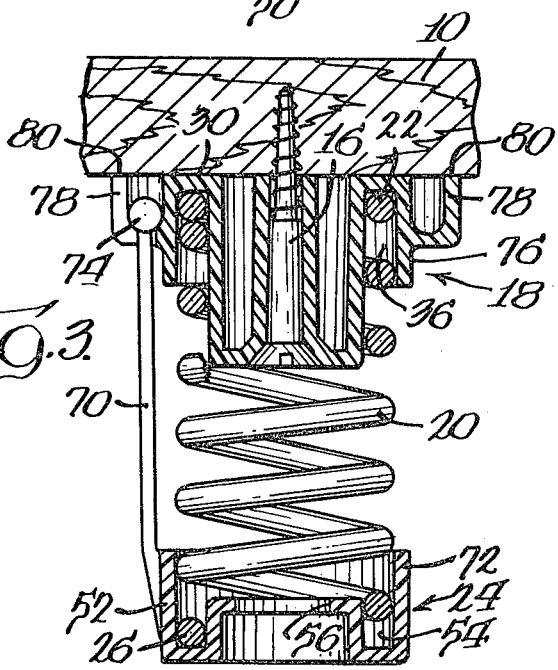
FIG. 3 is a view similar to FIG. 2 but of a modified embodiment of the spring assembly.
Figure 4:
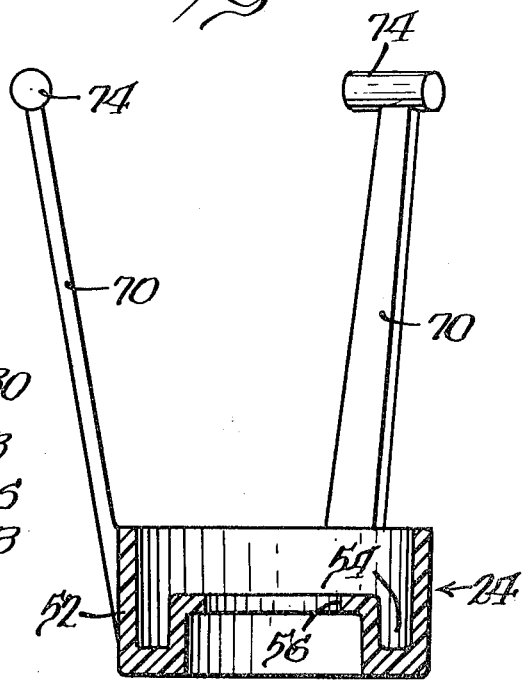
FIG. 4 is a sectional view of a portion of the spring assembly illustrated in FIG. 3.

The basic components of the embodiment illustrated in FIGS. 3 and 4 are identical to those described in connection with FIG. 2 and in the interest of brevity, will not be described further. It is, however, to be noted that the embodiment of FIGS. 3 and 4 includes additional components which will now be described in detail.

Specifically, flexible and collapsible interconnections in the form of straps 70 interconnect the cap 18 and the protective cover 24. In the usual case, three such straps 70 will be employed and the same are formed of plastic, integrally with the protective cover 24 on the radially outer surface 72 of the lip 52. In an unstressed condition, the strips 70 assume the configuration illustrated in FIG. 4 and will be disposed about the lip 52 at 120° intervals. Each strap 70, at its end remote from the cover 24, terminates in a cylindrical cross member 74 to provide fo an overall T-shape for each strap 70.

Because the straps 70 are formed of plastic, it will be appreciated that they can flex and collapse somewhat upon compression of the spring 20 during use of the tumbling board. However, their length is such as to not exceed the overall length of the assembly to thereby positively hold the components in assembled relation. To achieve this, the radially outer surfaces 76 of the lip 34 on the cap 18 is provided with aligned, integral hooks 78, usually six in number, which are paired. The spacing between the hooks 78 of each pair is slightly larger than the width of the strap 70 adjacent the cross member 74 while each pair of hooks is spaced at 120° intervals. It will be observed from FIG. 3 that the end 80 of teach hook 78 terminates in the plane of the base 30 of the cap 18.

In the case of the embodiment illustrated in FIGS. 3 and 4, assembly is achieved as follows. The spring ends 22 and 26 are forced to the bottoms of the respective grooves 36 and 54 in which they are received. The spring 20 is then slightly compressed by oppositely directed forces applied to the cap 18 and the protective cover 24 until the cross members 74 of the straps 70 extend beyond the ends 80 of the hooks 78. At this time, the free ends of the straps 70 are deflected radially inwardly such that the ends 74 of the cross members overlie associated ones of the hooks 78. Compression of the spring 20 may then be released with the result that the assemblage will assume a configuration illustrated in FIG. 3. To install the spring assembly thus formed on a tumbling board 10, the screw 16 is then introduced through the aperture 56 in the protective cover 24 and threaded into the tumbling board 10. It will be observed that when such assembly is completed, the tumbling board 10 itself obstructs movement of the cross members 74 on the strap 70 out of the hook 78 thereby absolutely preventing inadvertant disassembly of the spring construction.

Figure 5:
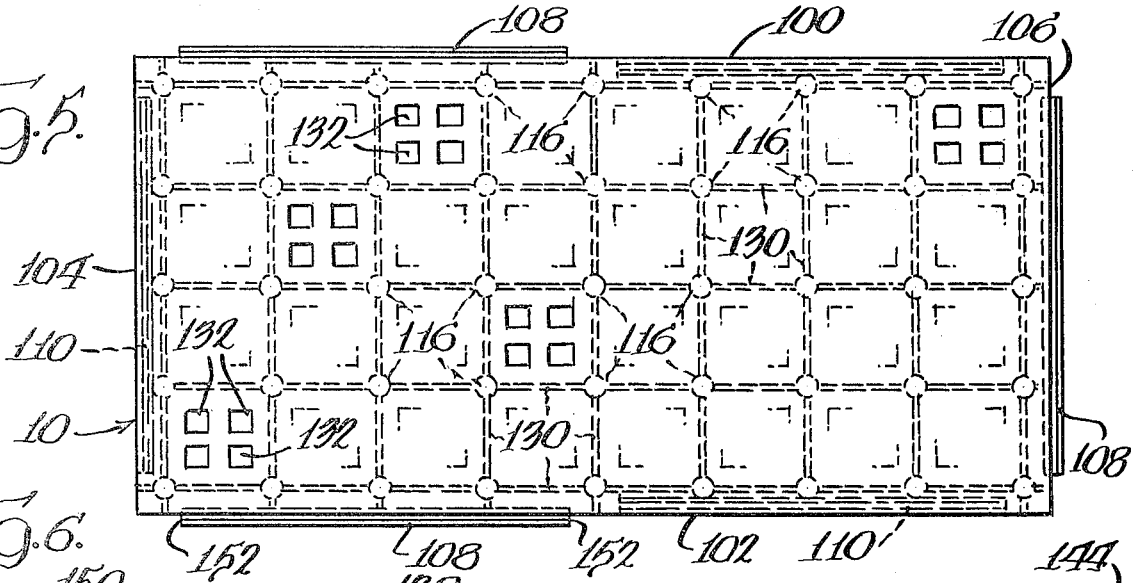
FIG. 5 is a plan view of a tumbling board.
Figure 6:
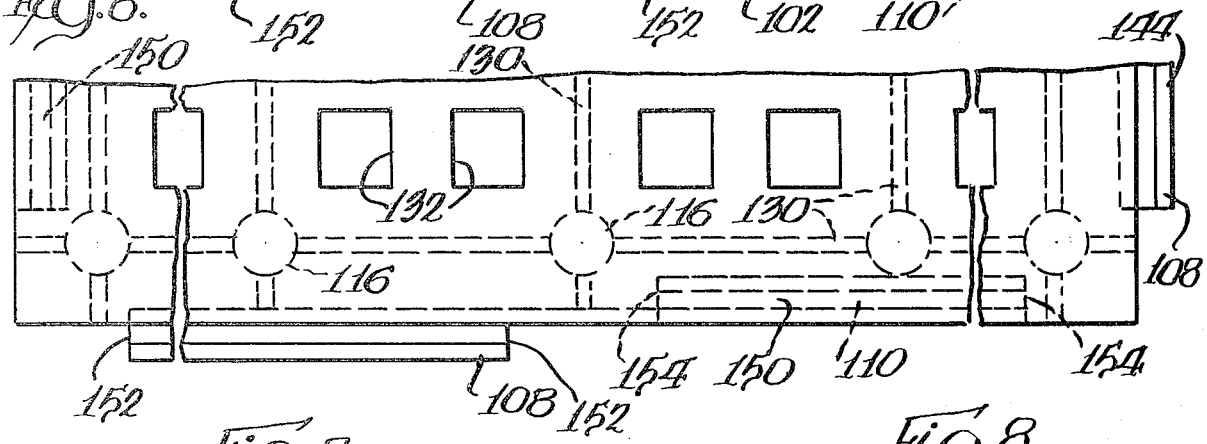
FIG. 6 is an enlarged, fragmentary view of the tumbling board.

While such spring assemblies can be utilized with virtually any type of tumbling board 10, it is preferred that they be employed with a tumbling board such as shown in FIGS. 5–10 hereof. Referring specifically to FIGS. 5 and 6, the tumbling board 10, which it will be recalled is rectangular, has two opposed sides 100 and 102 which have twice the length of the remaining sides 104 and 106. Typically, the tumbling board 10 will be three feet by six feet or four foot by eight foot, as desired.

In alternating fashion about the periphery of the tumbling board 10, there are located male and female interlocking devices, 108 and 110, respectively. In a preferred embodiment, there are six of the interlocking devices 108 and 110 in all with one interlocking device, specifically a male interlocking device 108 employed on the side 106 and one interlocking device, specifically a female interlocking device 110 employed on the side 104. Each of the sides 100 and 102 has both a male and a female interlocking device 108 and 110 and because the two type of interlocking devices are alternated, the configuration in FIG. 5 results. The specific construction of each of the interlocking devices 108 and 110 will be described in greater detail hereinafter.

Figure 9:
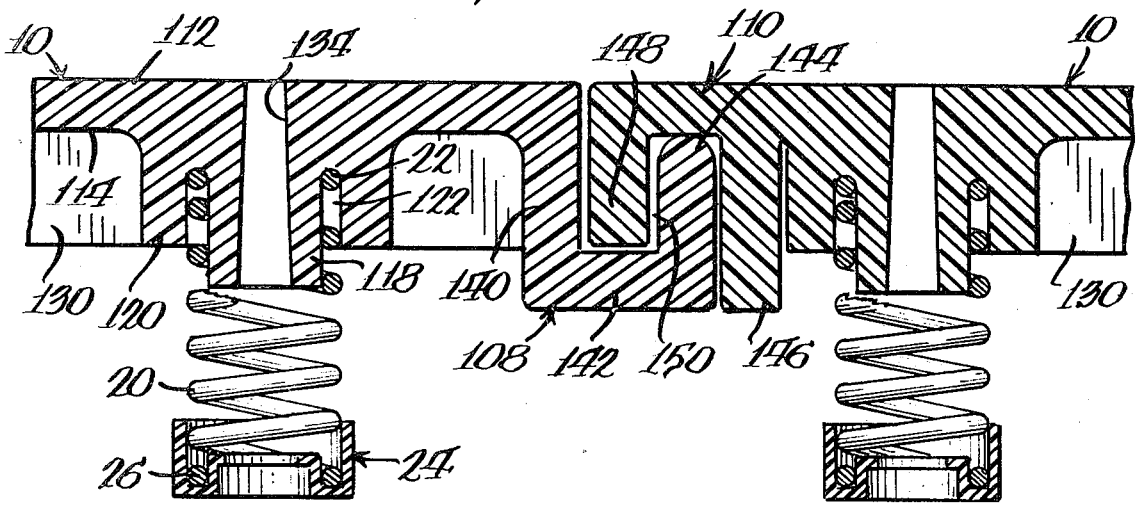
FIG. 9 is an enlarged, sectional view of interlocking devices interconnecting two identical tumbling boards which additionally employ spring assemblies generally similar to those illustrated in FIG. 2.

With reference to FIGS. 5 and 9, the tumbling board 10 is seen to include an upper face 112 and a lower face 114. The upper face 112 is adapted to support a tumbling mat such as that shown at 12 in FIG. 1 and accordingly in planar. At the various locations shown at 116 in FIG. 5, the lower face 114 includes downwardly extending generally cylindrical projections or bosses 118 which are formed generally similarly to the cylindrical projections 32 described previously in connection with FIG. 2. The bosses 118 are surrounded by annular lips 120, also extending downwardly from the lower face 114 to define an annular groove 122 corresponding to the annular lip 34 and the annular groove 36, respectively, described in connection with FIG. 2. The annular groove 122 receives the end 22 of the helical spring 20 while the opposite end 26 of the spring is disposed in a cap or protective cover identical to the cover 24. Preferably, the sheet forming the board 10 as well as the elements 118, 120 and 122 are integrally molded of suitably plastic or foam type materials which develop skins thereon. For example, suitable materials include polypropylene copolymers, linear polyethylene, nylon and Cycolac.

To minimize the amount of such material required to allow economic construction of the tumbling board, as well as to minimize the weight of the tumbling board so as to improve its portability between sites of use and sites of storage, the lower face 114 is provided with a plurality of strengthening ribs 130 which extend between the lips 120 as seen in FIG. 5 and FIG. 9 to form a rectangular grid as shown in FIG. 5. This allows the sheet to be formed of lesser thickness than might otherwise be the case.

To further minimize the weight of the assembly and material requirements, a plurality of apertures 132 (FIG. 5) extend between the faces 112 and 114. As illustrated in FIG. 5, there are four such apertures 132 arranged in a square type pattern in each of the grids defined by the strengthening ribs 130.

A further weight and material savings may be achieved through the use of apertures 134 located coaxially with each of the bosses 118 and extending through the tumbling board 10 as illustrated in FIG. 9.

FIG. 9 additionally illustrates the details of the male and female interlocking devices 108 and 110. Each male interlocking device includes a downwardly extending arm 140 at the appropriate location about the periphery of the tumbling board 10 which terminates in a horizontally directed arm 142. An upwardly directed flange 144 extends upwardly from the arm 142 and is spaced from the arm 140. It will be noted that the upper most extent of the flange 144 is below the upper face 112 of the tumbling board 10.

Each female interlocking device includes a downwardly extending projection 146 inwardly of the corresponding point on the periphery of the tumbling board 10 and a similar projection 148 spaced therefrom toward the periphery to define a downwardly opening groove 150 in which the flange 144 may be received. It will be noted that the width of the groove 150 is slightly larger than the width of the flange 144 so as to allow the latter to be easily inserted in the former and moved slightly therein. Typically, the width of the groove 150 might exceed the width of the flange 144 by about 1/16 of an inch.

As seen in FIGS. 5 and 6, both the flange 144 and the groove 150 are horizontally elongated and the associated structure such as the arms 140 and 142 and the projections 146 and 148 terminate in flat ends 152 and 154 respectively.

Figure 10:
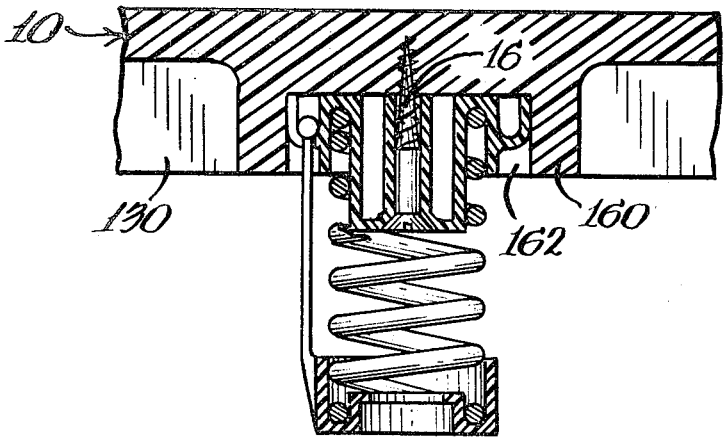
FIG. 10 illustrates a modified embodiment of the tumbling board which utilizes spring assemblies generally similar to those illustrated in FIGS. 3 and 4.

FIG. 10 illustrates an alternate embodiment of the tumbling board which is particularly adapted for use with spring assemblies such as are illustrated in FIGS. 3 or 4. At locations corresponding to those illustrated in FIG. 5 at 116, in lieu of the bosses 118, lips 120 and grooves 122, there may be provided a lip 160 defining a generally cylindrical recess 162 for receipt of the base structure 18 illustrated in FIG. 3. A screw 116 may be utilized to hold the same in place.

Figure 7:
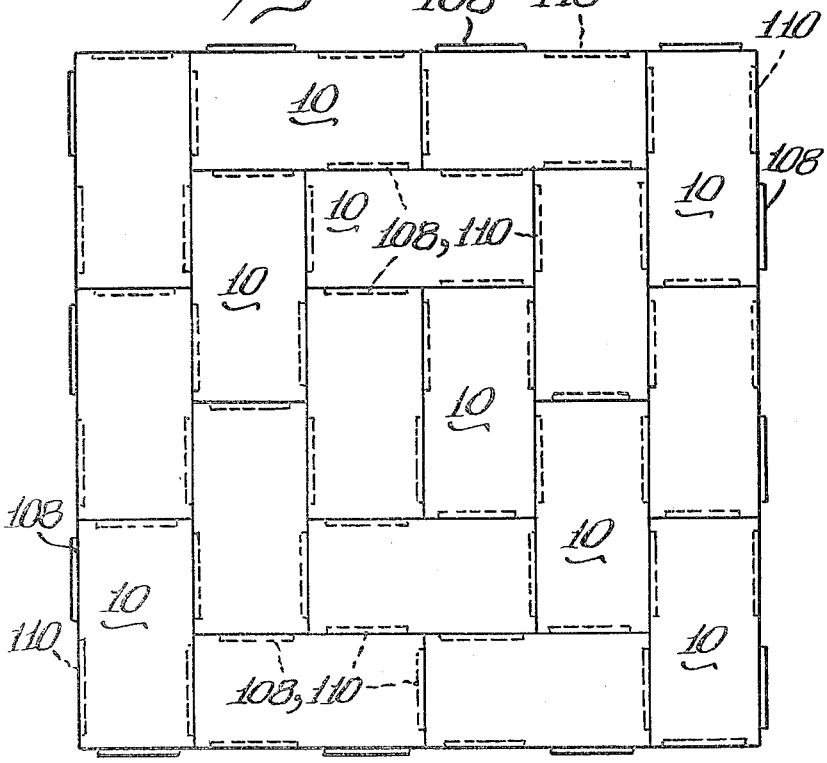
FIG. 7 illustrates, somewhat schematically, one pattern of interconnection of a plurality of identical tumbling boards made according to the invention.

With reference now to FIG. 7, an assembly of eight of the tumbling boards 10 is illustrated. Specifically shown is just one of many patterns whereby a plurality of the tumbling boards may be interlocked together to form a square tumbling board surface for supporting a large, square mat. It will be appreciated that the assembly can be expanded indefinitely to support any size mat because of the unique arrangement wherein the male and female interlocking devices 108 and 110 are alternated about the periphery of each of the boards. It will be observed that each of the boards 10 shown in FIG. 7 is identical to the others and this is particularly desirable since, as mentioned, the boards are typically formed by molding. Thus, only a single mold may be utilized to form identical boards which may be interlocked simply by reversing the position of one board with respect to another to align the female locking devices 110 on one board with the male interlocking device on an adjacent board. As mentioned, in the preferred embodiment, one dimension of each of the boards is twice that of the other dimension with the short sides of the boards having but one locking device thereon and the long dimensions having two locking devices. It will be appreciated, however, that the same interchangeability and flexibility of layout could be achieved by providing two differing types of locking devices on each of the short edges and four of the locking devices on each of the long edges so long as the alternating arrangement is maintained.

It will also be appreciated that lateral movement of one of the boards with respect to the other of any appreciable extent cannot occur. This is due to the fact that the locking devices occupy substantially the entire periphery of each of the boards, are of equal length, and have the flat edges 152 and 154 mentioned previously. Before any appreciable movement can occur, the flat edges will abut one another.

Figure 8:
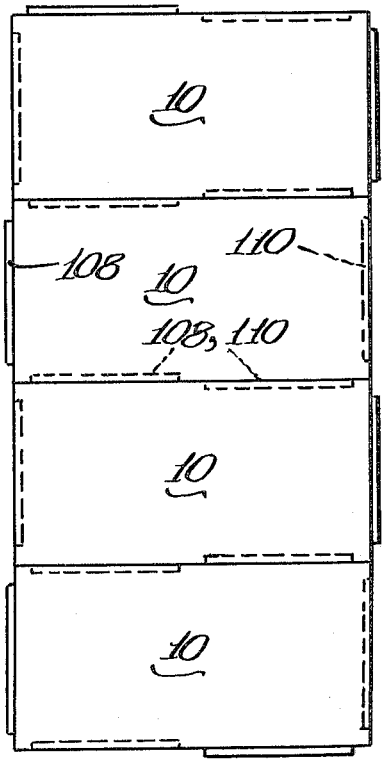
FIG. 8 illustrates, somewhat schematically, another pattern of interconnection of a plurality of identical tumbling boards made according to the invention.

FIG. 8 illustrates an arrangement whereby a plurality of boards are interengaged to form an elongated strip. This arrangement of boards can be used when the mat is more of a runner-like shape.

It will also be appreciated that the vertical orientation of the groove 150 and the flange 144 prevents vertical disassociation of the boards even when the boards are subjected to substantial vertical stresses at their point of abutment as a result of jumping exercises performed thereon. Consequently, the boards cannot become disassociated during use but are susceptible to easy disassembly by twisting one board relative to another or simply by lifting one board with respect to another depending upon the point of engagement with each other. Thus, the boards need only be properly interfitted for assembly purposes and no manual acts in terms of moving movable interlocking devices such as hinge pintles or hooks need be performed either during the assembly or the disassembly process. The boards are relatively light in weight and inexpensive to fabricate by reason of the provision of the apertures 132 and 134 and may thus be easily transported between a point of use and a point of storage. In the embodiment illustrated in FIG. 9, disposition of the spring assemblies on the boards is quite simple by reason of the use of the integrally formed components 118, 120 and 122 and yet, according to the embodiment of FIG. 10, provision for positive retention of a spring assembly once secured to the board is maintained.

While the preferred embodiment utilizes molded tumbling boards formed of plastic or the like, it will be appreciated that the invention is also suceptible to construction in other forms. For example, if desired, plywood could nonetheless be used with the interlocking devices formed of molding or the like secured to the periphery of the board. Such a board would not possess all of the advantages of the preferred embodiment but would retain substantial advantage of ease of assembly and disassembly.

I claim:

1. A tumbling surface construction comprising a plurality of rectangular sheets in adjacency to each other, each having two opposed sides of a length that is a multiple of the length of the remaining two sides, an upper surface and a lower surface;

means interconnecting said sheets and comprising a plurality of stationary male and female interlocking devices about the periphery of each sheet in alternating fashion and disposed below said upper surface, said interlocking devices being generally upwardly and downwardly directed and of substantially equal length along the periphery of said sheets with the male interlocking devices on each sheet being interconnectingly received in female interlocking devices in adjacent sheets, there further being at least one male and one female interlocking device on each of said opposed sides, and a plurality of spring assemblies secured to the lower surfaces of said sheets at spaced locations thereon, whereby tumbling may be performed on said upper surfaces and be resiliently cushioned by said springs with the upwardly and downwardly directed male and female interlocking devices in alternating fashion preventing disassociation of adjacent sheets in side to side, end to end and up and down directions during the performance of a tumbling exercise.

2. The tumbling surface of claim 1 wherein the length of each of said opposed sides is twice the length of each of said remaining sides, and each of said opposed sides has a single one of each of said male and female interlocking devices with one of said remaining sides having a female interlocking device and the other of said remaining sides having a male interlocking device, each of said interlocking devices being elongated and of a length approximately equal to the length of one of said remaining sides.

3. The tumbling surface of claim 2 wherein said male interlocking devices comprise vertically directed flanges and said female interlocking devices comprise vertically directed grooves.

4. The tumbling surface of claim 1 wherein said interlocking devices are elongated and have ends in substantial engagement with the ends of an adjacent interlocking device on an adjacent ones of said sheets.

5. The tumbling surface of claim 4 wherein one of said male and female interlocking devices are just within said periphery and the other of said male and female interlocking devices are located just beyond said periphery.

* * * * *